United States Patent [19]

El-Sayed et al.

[11] Patent Number: 4,783,388

[45] Date of Patent: Nov. 8, 1988

[54] QUATERNARYAMMONIUM HYDROXIDE AS ADJUVANT FOR LIQUID ELECTROSTATIC DEVELOPERS

[75] Inventors: Lyla M. El-Sayed, West Chester, Pa.; James R. Larson, Greenville, Del.

[73] Assignee: E. I. Du Pont de Nemours and Company, Wilmington, Del.

[21] Appl. No.: 63,219

[22] Filed: Jun. 17, 1987

[51] Int. Cl.[4] ..... G03G 9/12

[52] U.S. Cl. ..... 430/115; 430/116

[58] Field of Search ..... 430/114, 115, 117, 116

[56] References Cited

U.S. PATENT DOCUMENTS

| | | | |
|---|---|---|---|
| 3,778,287 | 12/1973 | Stansfield et al. | 106/308 Q |
| 4,146,494 | 3/1979 | Hectors et al. | 252/62.1 P |
| 4,606,989 | 8/1986 | Uytterhoeven et al. | 430/115 |

*Primary Examiner*—John L. Goodrow

[57] ABSTRACT

Negative-working electrostatic liquid developer having improved charging characteristics consisting essentially of (A) nonpolar liquid having a Kauri-butanol value of less than 30, present in a major amount, (B) thermoplastic resin particles having an average by area particle size of less than 10 μm, (C) nonpolar liquid soluble ionic or zwitterionic compound, and (D) a quaternaryammonium hydroxide compound as defined, e.g., tetraethylammonium hydroxide, tetrabutylammonium hydroxide, etc., soluble in an amount of at least 0.5 part per million by weight in the nonpolar liquid.

The electrostatic liquid developer is useful in copying, making proofs including digital color proofs, lithographic printing plates, and resists.

17 Claims, No Drawings

QUATERNARYAMMONIUM HYDROXIDE AS ADJUVANT FOR LIQUID ELECTROSTATIC DEVELOPERS

TECHNICAL FIELD

This invention relates to an electrostatic liquid developer having improved charging characteristics. More particularly this invention relates to a negative-working electrostatic liquid developer containing as a constituent a quaternaryammonium hydroxide compound.

BACKGROUND ART

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid developers comprise a thermoplastic resin and dispersant nonpolar liquid. Generally a suitable colorant is present such as a dye or pigment. The colored thermoplastic resin particles are dispersed in the nonpolar liquid which generally has a high-volume resistivity in excess of $10^9$ ohm centimeters, a low dielectric constant below 3.0 and a high vapor pressure. The said particles are less than 10 μm average by area size. After the latent electrostatic image has been formed, the image is developed by the colored thermoplastic resin particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound to the liquid developer comprising the thermoplastic resin, dispersant nonpolar liquid and generally a colorant. Such liquid developers, while developing good quality images, still do not provide the quality images required for certain end uses, e.g., optimum machine performance in digital color proofing. As a result much research effort has been expended in providing new type charge directors and/or charging adjuvants for electrostatic liquid developers. Higher quality image development of latent electrostatic images is still desired.

It has been found that the above disadvantages can be overcome and improved electrostatic liquid developers prepared containing an ionic or zwitterionic compound soluble in nonpolar liquid which have improved image quality or latent electrostatic images.

DISCLOSURE OF THE INVENTION

In accordance with this invention there is provided a negative-working electrostatic liquid developer having improved charging characteristics consisting essentially of (A) a nonpolar liquid having a Kauri-butanol value of less than 30, present in a major amount, (B) thermoplastic resin particles having an average by area particle size of less than 10 μm, (C) a nonpolar liquid soluble ionic or zwitterionic compound, and (D) a quaternaryammonium hydroxide compound of the formula:

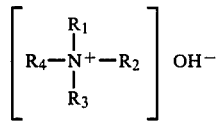

wherein $R_1$, $R_2$, $R_3$ and $R_4$ respresent aliphatic or aromatic hydrocarbon groups, said compound being soluble in an amount of at least 0.5 part per million by weight in the nonpolar liquid.

Throughout the specification the below-listed terms have the following meanings:

In this claim appended hereto "consisting essentially of" means the composition of the electrostatic liquid developer does not exclude unspecified components which do not prevent the advantages of the developer from being realized. For example, in addition to the primary components, there can be present additional components such as colorants, fine particle size oxides, metallic soaps, other adjuvants, etc.

Nonpolar liquid soluble ionic or zwitterionic compounds (C) are referred to throughout as charge directors.

Conductivity is the conductivity of the developer measured in picomhos (pmho)/cm at 5 hertz and 5 volts.

The electrostatic liquid developer, as defined above comprises four primary components more specifically described below. Additional components, in addition to the four primary components, include but are not limited to: colorants such as pigments or dyes, which are preferably present, fine particle size oxides, metals, metallic soaps, other adjuvants, etc.

The dispersant nonpolar liquids (A) are, preferably, branched-chain aliphatic hydrocarbons and more particularly, Isopar®-G, Isopar®-H, Isopar®-K, Isopar®-L, Isopar®-M and Isopar®-V.

These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C., Isopar®-M between 207° C. and 254° C. and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar ®12 | 69 | 204 |
| Norpar ®13 | 93 | 210 |

-continued

| Liquid | Flash Point (°C.) | Auto-Ignition Temp (°C.) |
|---|---|---|
| Norpar ®15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar ®-L and Isopar ®-M have flash points of 61° C., and 80° C., respectively, determined by the same method. While there are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature.

Useful thermoplastic resins or polymers include: ethylene vinyl acetate (EVA) copolymers (ELvax ® resins, E. I. du Pont de Nemours and Company, Wilmington, DE), copolymers of ethylene and an $\alpha,\beta$ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite ® DPD 6169, DPDA 6182 Natural and DTDA 9169 Natural by Union Carbide Corp., Stamford, CN: ethylene vinyl acetate resins, e.g., DQDA 6479 Natural and DQDA 6832 Natural 7 also sold by Union Carbide Corp.; Surlyn ® ionomer resin by E. I. du Pont de Nemours and Company, Wilmington, DE, etc. Preferred copolymers are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 60 and a melt index of 100 and 500 determined at 190° C., respectively.

In addition, the resins have the following preferred characteristics:

1. Be able to disperse any colorant, e.g., pigment; metallic soap, etc., that may be present,
2. Be substantially insoluble in the dispersant liquid at temperatures below 40° C., so that the resin will not dissolve or solvate in storage,
3. Be able to solvate at temperatures above 50° C.,
4. Be able to be ground to form particles between 0.1 μm and 5 μm, in diameter,
5. Be able to form a particle (average by area) of less than 10 μm size e.g., dedetermined by Horiba CAPA-500 centrifugal automatic particle analyzer, manufactured by Horiba Instruments, Inc., Irvine, CA: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm.
6. Be able to fuse at temperatures in excess of 70° C.

By solvation in 3. above, the resins forming the toner particles will become softened, swollen or gelatinous.

Suitable nonpolar liquid soluble ionic or zwitterionic compounds (C), which are used in an amount of 1 to 1000 mg/g, preferably 1 to 100 mg/g developer solids, include: negative charge directors, e.g., lecithin, Neutral Barium Petronate ® oil-soluble petroleum sulfonate, manufactured by Sonneborn Division of Witco Chemical Corp., New York, NY, alkyl succinimide (manufactured by Chevron Chemical Company of California), etc. Negative charge directors such as Basic Calcium Petronate ® and Basic Barium Petronate ® do not provide advantages of the invention. The reason for this is not known but it may be that these materials are too basic.

The fourth component of the electrostatic liquid developer is (D) a quaternaryammonium hydroxide compound soluble in an amount of at least 0.5 part per million by weight in the nonpolar liquid. The quaternaryammonium hydroxide compound is thoroughly dispersed throughout the developer and is represented by the formula:

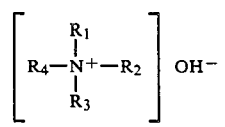

wherein $R_1$, $R_2$, $R_3$ and $R_4$ represent aliphatic or aromatic hydrocarbon groups, said compound being soluble in an amount of at least 0.5 part per million by weight in the nonpolar liquid.

The aforementioned aliphatic or aromatic hydrocarbon groups present in the compound may be substituted, e.g., with halogens such as chloride, bromide, hydroxyl, etc., groups. Particularly effective among these compounds are tetraethyl-, tetrapropyl-, and tetrabutylammonium hydroxide. The quaternaryammonium hydroxide compound is generally used in an amount of 0.001 to 100 mg/g, preferably 0.01 to 10 mg/g total developer.

Components (A) and (B) are present in the electrostatic liquid developer in the following amounts.

Component (A): 99.9 to 85% by weight, preferably 99.5 to 98% by weight; and

Component (B): 0.1 to 15% by weight, preferably 0.5 to 2% by weight. The amounts of components (C) and (D) in the developer are set out above and are not included in considering weight of developer solids.

As indicated above, additional components that can be present in the electrostatic liquid developer are colorants, such as pigments or dyes and combinations thereof, are preferably present to render the latent image visible, though this need not be done in some applications. The colorant, e.g., a pigment, may be present in the amount of up to about 60 percent by weight or more based on the weight of the resin. The amount of colorant may vary depending on the use of the developer. Examples of pigments are Monastral® Blue G (C.I. Pigment Blue 15 C.I. No. 74160), Toluidine Red Y (C.I. Pigment Red 3), Quindo® Magenta (Pigment Red 122), Indo® Brilliant Scarlet (Pigment Red 123, C.I. No. 71145), Toluidine Red B (C.I. Pigment Red 3), Watchung® Red B (C.I. Pigment Red 48), Permanent Rubine F6B13-1731 (Pigment Red 184), Hansa® Yellow (Pigment Yellow 98), Dalamar® Yellow (Pigment Yellow 74, C.I. No. 11741), Toluidine Yellow G (C.I. Pigment Yellow 1), Monastral® Blue B (C.I. Pigment Blue 15), Monastral® Green B (C.I. Pigment Green 7), Pigment Scarlet (C.I. Pigment Red 60), Auric Brown (C.I. Pigment Brown 6), Monastral® Green G (Pigment Green 7), Carbon Black, Cabot Mogul L (black pigment C.I. No. 77266) and Sterling NS N 774 (Pigment Black 7, C.I. No. 77266).

Fine particle size oxides, e.g., silica, alumina, titania, etc.; preferably in the order of 0.5 μm or less can be dispersed into the liquefied resin. These oxides can be used alone or in combination with the colorants. Metal particles can also be added.

Metallic soap, e.g., aluminum tristearate, aluminum distearate, barium, calcium, lead and zinc stearates; cobalt, manganese, lead and zinc linoleates; aluminum, calcium and cobalt octoates, calcium and cobalt oleates, zinc palmitate, calcium, cobalt, manganese, lead and zinc napthenates, calcium, cobalt, manganese, lead and zinc resinates, etc., can be dispersed into the liquified resin. The metallic soap is dispersed as described in Trout U.S. application Ser. No. 857,326, filed Apr. 30, 1986, in the resin.

The pigment when present in the thermoplastic resin is present in an amount of 1% to 60% by weight, preferably 1 to 30% by weight. The metallic soap, when present, is useful in an amount of 0.01 to 60 percent by weight based on the total weight of the developer solids.

The particles in the electrostatic liquid developer have an average by area particle size of less than 10 μm, preferably the average by area particle size is less than 5 μm. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, brisles, or the like.

The electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, CA, equipped with particulate media for dispersing and grinding, Ross double planetary mixer manufactured by Charles Ross and Son, Hauppauge, NY, etc., are placed the above-described ingredients. Generally the resin, dispersant nonpolar liquid and optional colorant are placed in the vessel prior to starting the dispersing step although after homogenizing the resin and the dispersant nonpolar liquid the colorant can be added. The dispersing step is generallly accomplished at elevated temperature, i.e., the temperature of ingredients in the vessel being sufficient to plasticize and liquefy the resin but being below that at which the dispersant nonpolar liquid degrades and the resin and/or colorant decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc. taken from the class consisting of stainless steel, alumina, ceramic, zirconium, silica, and sillimanite. Carbon steel particulate media is useful when colorants other than black are used. A typical diameter range for the particulate media is in the range of 0.04 to 0.5 inch (1.0 to ~13 mm).

After dispersing the ingredients in the vessel until the desired dispersion is achieved, typically 1 to 2 hours with the mixture being fluid, the dispersion is cooled, e.g., in the range of 0° C. to 50° C. Cooling may be accomplished, for example, in the same vessel, such as the attritor, while simultaneously grinding in the presence of additional liquid with particulate media to prevent the formation of a gel or solid mass; without stirring to form a gel or solid mass, followed by shredding the gel or solid mass and grinding, e.g., by means of particulate media in the presence of additional liquid; or with stirring to form a viscous mixture and grinding by means of particulate media in the presence of additional nonpolar liquid. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipiates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time.

After cooling and separating the dispersion of toner particles from the particulate media, if present, by means known to those skilled in the art, it is possible to reduce the concentration of the toner particles in the dispersion. The concentration of the toner particles in the dispersion is reduced by the addition of additional dispersant nonpolar liquid as described previously above. The dilution is normally conducted to reduce the concentration of toner particles to between 0.1 to 3 percent by weight, preferably 0.5 to 2 weight percent with respect to the dispersant nonpolar liquid. One or more negative nonpolar liquid soluble ionic or zwitterionic compounds, of the type set out above, can be added to impart a negative charge. The addition may occur at any time during the process. If a diluting dispersant nonpolar liquid is also added, the ionic or zwitterionic compound can be added prior to, concurrently with, or subsequent thereto. If the quaternaryammonium hydroxide compound has not been previously added in the preparation of the liquid developer, it can be added subsequent to the liquid developer being charged. Preferably the quaternaryammonium hydroxide compound is added with the ionic or zwitterionic compound. A preferred embodiment of the invention is described in Example 1.

INDUSTRIAL APPLICABILITY

The electrostatic liquid developers of this invention demonstrate improved charging qualities such as increased density and resolution. The developers of this invention are useful in copying, e.g., making office copies of black and white as well as various colors; or color proofing, e.g., a reproduction of an image using the standard colors: yellow, cyan, magenta together with black as desired. In copying and proofing the toner particles are applied to a latent electrostatic image.

Other uses are envisioned for the electrostatic liquid developers include: digital color proofing, lithographic printing plates, and resists (preferably nonpigmented).

EXAMPLES

The following examples wherein the parts and percentages are by weight, illustrate but do not limit the invention. In the Examples, the melt indices were determined by ASTM D 1238, Procedure A, the average particle sizes by area were determined by a Horiba CAPA-500 centrifugal particle analyzer as described above, conductivities were measured in picomhos (pmho)/cm at five hertz and low voltage, 5.0 volts, and the densities were measured using a Macbeth densitometer model RD 918. Resolution is expressed in the Examples in line pairs/mm (lp/mm).

EXAMPLES 1

In a Union Process 1-S Attritor, Union Process Company, Akron, Ohio, were placed the following ingredients:

| Ingredient | Amount (g) |
|---|---|
| Copolymer of ethylene (89%) and methacrylic acid (11%), melt index at 190° C. is 100, Acid No. is 66 | 200 |
| Monastral ® Blue BT-383D pigment | 22 |
| Isopar ®-L, nonpolar liquid having a Kauri-butanol value of 27, Exxon Corporation | 1000 |

The ingredients were heated to 100° C.±10° C. and milled at a rotor speed of 230 rpm with 0.1875 inch (4.76 mm) diameter stainless steel balls for two hours. The attritor was cooled to room temperature while the milling was continued and then 700 grams of Isopar ®-H, nonpolar liquid having a Kauri-butanol value of 27, Exxon Corporation, was added. Milling was continued at a rotor speed of 330 rpm for three hours to obtain toner particles with an average size of 0.8 μm by area. The particulate media were removed and the dispersion of toner particles was then diluted to 2.0 percent solids with additional Isopar ®-H. To 2,000 grams of this solution was added purified grade lecithin (Fisher Scientific, Fair Lawn, NJ) in the amount of 30 g of 2.5% lecithin in Isopar ®-H. In sample 1-A there were no further additives. In Sample 1-B, 30 grams of a 0.1 molar solution of tetrabutylammonium hydroxide (Aldrich Chemical Co., Milwaukee, WI) in 1:9 methanol:toluene was also added. Image quality was determined using a Savin 870 copier at standard mode: charging corona set at 6.8 kv and transfer corona set at 8.0 kv. The carrier sheet used was either Plainwell offset enamel paper, number 3 gloss, 60 lb. test, Plainwell Paper Co., Plainwell, MI or Savin 2200 office copier paper or a Savin transparency (imaged on either the rough side or the smooth side), as indicated. The results are summarized in Table 1 below.

TABLE 1

| Sample | Sub-Strate | Den-sity | Reso-lu-tion |
|---|---|---|---|
| 1-A (con-trol) | Savin | 0.23 | 2.8 |
| | Offset | 2.57 | 1.4 |
| | Transparency | | |
| | 1. Rough | 1.08 | 2.5 |
| | 2. Smooth | 2.08 | 3.6 |
| 1-B | Savin | 1.03 | 10.0 |
| | Offset | 1.78 | 10.0 |
| | Transparency | | |
| | 1. Rough | 0.95 | 10.0 |
| | 2. Smooth | 0.92 | 8.0 |

EXAMPLE 2

The procedure described in Example 1 was repeated with the following changes: The Monastral ® B-T383 D pigment was replaced with 18.5 grams Quinacridone RV-6803 (Mobay Corp., Haledon, NJ) and 3.5 grams Perylene ® R6300 (Mobay Corp., Haledon, NJ; an average particle size of 0.7 μm was obtained; to 2000 g of 2% solids developer were added 50 g of 2.5 percent lecithin in Isopar ®-H; in Sample 2-A there were no further additives; and in Sample 2-B, 20 g of 0.1 molar solution of tetrabutylammonium hydroxide in 1:9 methanol:toluene were also added. The results are summarized in Table 2 below.

TABLE 2

| Sample | Sub-Strate | Den-sity | Reso-lu-tion |
|---|---|---|---|
| 2-A (con-trol) | Savin | 0.76 | 4.5 |
| | Offset | 2.03 | 3.6 |
| | Transparency | | |
| | 1. Rough | 1.45 | 6.3 |
| | 2. Smooth | 1.28 | 5.0 |
| 2-B | Savin | 0.95 | 7.1 |
| | Offset | 1.32 | 7.1 |
| | Transparency | | |
| | 1. Rough | 1.03 | 8.0 |
| | 2. Smooth | 0.95 | 8.0 |

EXAMPLE 3

The procedure described in Example 1 was repeated with the following changes: The Monastral ® BT-383 D pigment was replaced with 22 grams Dalamar ® Yellow YT-858D (Heubach, Inc., Newark, NJ); an average particle size of 1.2 μm was obtained; to 1500 g of 2% solids developer were added 25 g of 2.5% lecithin in Isopar ®-H; in Sample 3-A there were no further additives; and in sample 3-B, 20 g of 0.1 molar solution of tetrabutylammonium hydroxide in 1:9 methanol:toluene were also added. The results are summarized in Table 3 below.

TABLE 3

| Sample | Sub-Strate | Den-sity | Reso-lu-tion |
|---|---|---|---|
| 3-A (con-trol) | Savin | 0.50 | 5.0 |
| | Offset | 2.20 | 7.1 |
| | Transparency | | |
| | 1. Rough | 0.83 | 5.6 |
| | 2. Smooth | 0.56 | 6.3 |
| 3-B | Savin | 0.74 | 5.0 |
| | Offset | 2.04 | 8.0 |

TABLE 3-continued

| Sample | Sub-Strate | Den-sity | Reso-lu-tion |
|---|---|---|---|
| | Transparency | | |
| | 1. Rough | 0.91 | 9.0 |
| | 2. Smooth | 0.96 | 9.0 |

EXAMPLE 4

The procedure described in Example 1 was repeated with the following changes: The Monastral® BT-383 D pigment was replaced with 10 grams Cabot's Sterling NS black pigment (Cabot Corp., Boston, MA); an average particle size of 1.4 μm was obtained; to 1500 g of 2% solids developer were added 41 g of B 2.5% lecithin in Isopar®-H; in Sample 4-A there were no further additives; and in Sample 4-B, 20 g of 0.1 molar solution of tetrabutylammonium hydroxide in 1:9 methanol:toluene were also added. The results are summarized in Table 4 below.

TABLE 4

| Sample | Sub-Strate | Den-sity | Reso-lu-tion |
|---|---|---|---|
| 4-A (con-trol) | Savin | 1.14 | 3.2 |
| | Offset | 1.56 | 4.0 |
| | Transparency | | |
| | 1. Rough | 1.20 | 3.2 |
| | 2. Smooth | 1.03 | 5.6 |
| 4-B | Savin | 0.91 | 5.6 |
| | Offset | 1.12 | 9.0 |
| | Transparency | | |
| | 1. Rough | 0.81 | 9.0 |
| | 2. Smooth | 0.78 | 9.0 |

EXAMPLE 5

In a Union Process O1 Attritor, Union Process Company, Akron, Ohio, were placed the following ingredients:

| Ingredient | Amount (g) |
|---|---|
| Copolymer of ethylene (89%) and methacrylic acid (11%), melt index at 190° C. is 100, Acid No. is 66 | 30 |
| Isopar ®-L, nonpolar liquid having a Kauri-butanol value of 27, Exxon Corporation | 150 |

The ingredients were heated to 100° C.±10° C. and milled with 0.1875 inch (4.76 mm) diameter stainless steel balls for 1.5 hours. The attritor was cooled to room temperature while the milling was continued and then 100 grams of Isopar®-H, nonpolar liquid having a Kauri-butanol value of 27, Exxon Corporation, was added. Milling was continued for four hours to obtain toner particles with an average size of 2.0 μm by area. The particulate media were removed and the dispersion of toner particles was then diluted to 2.0 percent solids with additional Isopar®-H. To 600 g of this solution was added purified grade lecithin (Fisher Scientific, Fairlawn, NJ) in the amount of 40 g of 2.5% lecithin in Isopar®-H. In Sample 5-A there were no further additives. In Sample 5-B a solution of 0.1 molar tetrabutylammonium hydroxide (Aldrich Chemical Co., Milwaukee, WI) in 1:9 methanol:toluene was added in the amount of 16 grams. Image quality was determined using a Savin 870 copier as described in Example 1 using as a carrier sheet Plainwell offset enamel paper, number 3 gloss, 60 lb. test, Plainwell Paper Co., Plainwell, MI. The results are summarized in Table 5 below.

TABLE 5

| Sample | Reso-lu-tion |
|---|---|
| 5-A (control) | 3.6 |
| 5-B | 5.0 |

EXAMPLE 6

The procedure described in Example 1 was repeated except that in place of lecithin, Neutral Barium Petronate® oil-soluble petroleum sulfonate, Sonneborn Division of Witco Chemical Corp., New York, N.Y., was added to the level of 44 g of 5.5% Neutral Barium Petronate® in Isopar®-H to 1960 g of 2% solids developer. In Sample 6-A there were no further additives. In Sample 6-B tetrabutylammonium hydroxide was added to the level of 20 g of a 0.1 molar solution of tetrabutylammonium hydroxide in 1:9 methanol:toluene. The developers were evaluated as described in Example 1. Sample 6-A gave positive toner particles and a reverse negative image. Sample 6-B gave negative toner particles and a normal image.

EXAMPLE 7

Ten grams of poly (2-acrylamido-2-methyl-1-propane sulfonic acid) 10% aqueous solution (Aldrich Chemical Co., Milwaukee, WI) was dispersed in 100 grams of a copolymer of ethylene (89%) and methacrylic acid (11%), melt index at 190° C. is 100, Acid No. is 66, by two roll milling at 120° C. for 25 minutes. In this was dispersed 7.1 grams of Heucophthal Blue G XBT-583D pigment (Heubach, Inc., Newark, NJ) and the blend was chopped in a blender with liquid nitrogen.

In a Union Process O1 Attritor, Union Process Company, Akron, Ohio, were placed the following ingredients:

| Ingredient | Amount (g) |
|---|---|
| Above chopped material | 40 |
| Isopar ®-L, nonpolar liquid having a Kauri-butanol value of 27, Exxon Corp. | 125 |
| Isopar ®-H, nonpolar liquid having a Kauri-butanol value of 27, Exxon Corp. | 125 |

The ingredients were milled with 0.1875 inch (4.76 mm) diameter stainless steel balls for 61.5 hours to obtain toner particles with an average size of 0.93 μm by area. The particulate media were removed and the dispersion of toner particles was then diluted to 2.0 percent solids with additional Isopar®-H. To 2000 grams of this solution were added 20 grams of Neutral Barium Petronate® as described in Example 6. In Sample 7-A there were no further additives. In Sample 7-B 20 grams of a 0.1 molar solution of tetrabutylammonium hydroxide in 1:9 methanol:toluene were added. Image quality was determined as described in Example 1 using Plainwell offset enamel paper. The results are shown in Table 6 below.

TABLE 6

| Sample | Resolution | Density |
|---|---|---|
| 7-A (control) | 1.8 | 0.39 |
| 7-B | 8.0 | 0.43 |

EXAMPLE 8

In a Union Process 1-S Attritor, Union Process Company, Akron, Ohio were placed the following ingredients:

| Ingredient | Amount (g) |
|---|---|
| Copolymer of ethylene (89%) and methacrylic acid (11%), melt index at 190° C. is 100, Acid No. is 66 | 200.0 |
| Heucophthal Blue B XBT-583D Heubach, Inc., Newark, NJ | 14.1 |
| Dalamar ® yellow pigment YT-858D Huebach, Inc., Newark, NJ | 0.17 |
| Isopar ®-L, nonpolar liquid having a Kauri-butanol value of 27, Exxon Corp. | 1000.0 |

The ingredients were heated to 100° C.±10° C. and milled at a rotor speed at 230 rpm with 0.1875 inch (4.76 mm) diameter stainless steel balls for two hours. The attritor was cooled to room temperature while the milling was continued and then 700 grams of Isopar ®-H, nonpolar liquid having a Kauri-butanol value of 27, Exxon Corporation, were added. Milling was continued at a rotor speed of 330 rpm for 22 hours to obtain toner particles with an average size of 0.92 μm by area. The particulate media were removed and the dispersion of toner particles was then diluted to 2.0 percent solids with additional Isopar ®-H. In Sample 8-A, 14 grams of Neutral Barium Petronate ® as described in Example 6saturated with water were added to 1200 grams of developer. In Example 8-B, 14 grams of Neutral Barium Petronate ® saturated with a 20% by weight solution of tetraethylammonium hydroxide in water were added to 1200 grams of developer. Image quality was evaluated as described in Example 1. The results are given in Table 7 below.

TABLE 7

| Sample | Resolution | Density |
|---|---|---|
| 8-A (control) | 2.0 | 0.06 |
| 8-B | 2.5 | 0.49 |

We claim:

1. A negative-working electrostatic liquid developer having improved charging characteristics consisting essentially of A. a nonpolar liquid having a Kauri-butanol value of less than 30, present in a major amount;

B. thermoplastic resin particles having an average by area particle size of less than 10 m;

C. a nonpolar liquid soluble ionic or zwitterionic compound; and

D. a quaternaryammonium hydroxide compound of the formula:

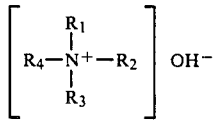

wherein $R_1$, $R_2$, $R_3$ and $R_4$ represent aliphatic or aromatic hydrocarbon groups, said compound being dispersed throughout the liquid developer and soluble in an amount of at least 0.5 part per million by weight in the nonpolar liquid, components (C) and (D) being present in an amount of 1 to 1000 mg/g developer solids and 0.0005 to 100 mg/g total developer, respectively.

2. An electrostatic liquid developer according to claim 1 wherein the quaternaryammonium hydroxide is tetraethylammonium hydroxide.

3. An electrostatic liquid developer according to claim 1 wherein the quaternaryammonium hydroxide is tetrabutylammonium hydroxide.

4. An electrostatic liquid developer according to claim 1 wherein the quaternaryammonium hydroxide is tetrapropylammonium hydroxide.

5. An electrostatic liquid developer according to claim 1 wherein component (A) is present in 99.9 to 85% by weight, component (B) is present in 0.1 to 15% by weight, based on the total weight of the developer, and component (C) is present in an amount of 1 to 1000 mg/g developer solids.

6. An electrostatic liquid developer according to claim 1 containing up to about 60% by weight of a colorant based on the weight of resin.

7. An electrostatic liquid developer according to claim 6 wherein the colorant is a pigment.

8. An electrostatic liquid developer according to claim 7 wherein the percent pigment in the thermoplastic resin is 1% to 60% by weight based on the weight of resin.

9. An electrostatic liquid developer according to claim 6 wherein the colorant is a dye.

10. An electrostatic liquid developer according to claim 1 wherein a fine particle size oxide is present.

11. An electrostatic liquid developer according to claim 1 wherein present in the thermoplastic resin is a metallic soap.

12. An electrostatic liquid developer according to claim 1 wherein the thermoplastic resin is a copolymer of ethylene and an α,β-ethylenically unsaturated acid selected from the class consisting of acrylic acid and methacrylic acid.

13. An electrostatic liquid developer according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

14. An electrostatic liquid developer according to claim 12 wherein the thermoplastic resin is a copolymer of ethylene (89%)/methacrylic acid (11%) having a melt index at 190° C. of 100.

15. An electrostatic liquid developer according to claim 1 wherein the particles have an average by area particle size of less than 5 μm.

16. An electrostatic liquid toner according to claim 1 wherein component (C) is Neutral Barium Petronate.

17. An electrosatic liquid toner according to claim 1 wherein component (C) is lecithin.

* * * * *